US005947690A

United States Patent [19]

Snel et al.

[11] Patent Number: 5,947,690

[45] Date of Patent: Sep. 7, 1999

[54] ACTUATOR VALVE FOR PRESSURE SWITCH FOR A FLUIDIC SYSTEM

[75] Inventors: Fred Snel, Stolwijk; Stefan Beekhuis, NH-Gouda, both of Netherlands; Wolf Joerg, Sharon, Mass.

[73] Assignee: Flexcon Industries, Randolph, Mass.

[21] Appl. No.: 09/090,723

[22] Filed: Jun. 4, 1998

Related U.S. Application Data

[60] Provisional application No. 60/049,234, Jun. 9, 1997.

[51] Int. Cl.[6] ..... F04B 49/02

[52] U.S. Cl. ..... 417/38

[58] Field of Search ..... 417/38

[56] References Cited

U.S. PATENT DOCUMENTS

| | | | |
|---|---|---|---|
| 3,493,001 | 2/1970 | Bevandich | 137/14 |
| 3,560,706 | 2/1971 | Fonecca | 219/301 |
| 3,739,810 | 6/1973 | Horan, Jr. | 137/568 |
| 3,782,858 | 1/1974 | Deters | 417/26 |
| 3,871,792 | 3/1975 | Gritz | 417/38 |
| 3,876,336 | 4/1975 | Nash | 417/38 |
| 3,922,111 | 11/1975 | Deters | 417/26 |
| 3,973,877 | 8/1976 | Taki | 417/38 |
| 4,124,332 | 11/1978 | Nishijyo | 417/26 |
| 4,247,260 | 1/1981 | Schonwald et al. | 417/38 |
| 4,281,968 | 8/1981 | Akers | 417/2 |
| 4,329,120 | 5/1982 | Walters | 417/12 |
| 4,659,291 | 4/1987 | Valdes | 417/44 |
| 5,099,544 | 3/1992 | Yamamoto | 15/339 |
| 5,190,443 | 3/1993 | Valdes | 417/38 |
| 5,197,859 | 3/1993 | Siff | 417/19 |
| 5,509,787 | 4/1996 | Valdes | 417/38 |

FOREIGN PATENT DOCUMENTS

| | | |
|---|---|---|
| 0 004 056 | 9/1979 | European Pat. Off. . |
| 0 459 434 | 12/1991 | European Pat. Off. . |
| 0 539 721 | 5/1993 | European Pat. Off. . |
| 1313115 | 11/1962 | France . |
| 2226514 | 11/1974 | France . |
| 83 15 687.9 | 7/1985 | Germany . |
| 2 173 344 | 10/1986 | United Kingdom . |
| 2 198 883 | 6/1988 | United Kingdom . |

OTHER PUBLICATIONS

PCT Search Report for Application No. PCT/US98/11559.

*Primary Examiner*—Timothy S. Thorpe
*Assistant Examiner*—Ehud Gartenberg
*Attorney, Agent, or Firm*—Choate, Hall & Stewart

[57] ABSTRACT

Hydraulic actuator. An actuator body includes an inlet, an outlet, a port communicating with a pre-charged diaphragm tank, and a port communicating with a pressure switch. The actuator body includes a movable member which, in a first position, seals the inlet port and provides fluidic communication with the pressure switch port. In a second position, the movable body opens the inlet port and seals the pressure switch port. A spring is disposed within the actuator body to urge the movable member toward the first position. The invention eliminates the need for multiple springs as shown in one prior art design and eliminates the need for reliance on a hydrostatic force differential to move the movable member.

20 Claims, 5 Drawing Sheets

ACTUATOR VALVE FOR PRESSURE SWITCH FOR A FLUIDIC SYSTEM

This application claims priority to U.S. provisional application Ser. No. 60/049,234, filed Jun. 9, 1997, now pending, the entire contents of which are incorporated herein by reference.

BACKGROUND OF THE INVENTION

Electrically operated pumps are used to supply water from wells and to boost the pressure of municipal water systems. Such pumps are operated by electric motors under the control of a pressure sensitive switch. Some prior art systems operate by keeping a reservoir tank substantially filled with water. In such a system, the pump motor turns on when pressure drops below a pre-set value and turns off when the pressure reaches another higher pre-set value. The duty cycle for the electric motor in such a system is high with numerous transitions from off to on and off again.

Alternative systems are known in which the pump runs when there is a demand for water and is off when the demand ceases. U.S. Pat. Nos. 5,190,443 and 5,509,787 are directed to actuators which control a pump based on demand. In these two patents, the interplay of hydrostatic and hydrodynamic forces moves a shuttle member which alternately opens and closes a passageway to allow pressure to communicate with a pressure-activated switch for controlling the pump motor. Another design as set forth in U.S. Pat. No. 3,871,792 utilizes a combination of hydrodynamic forces and spring forces to control a switch operate the pump motor. In particular, the configuration set forth in the '792 patent requires two springs, one to control the moving member of a poppet valve and another spring to control the motion of a flexible diaphragm. The design is also complicated by first and second internal auxiliary passageways to provide for pump motor control.

SUMMARY OF THE INVENTION

In one aspect, the hydraulic actuator of the invention includes an actuator body having an inlet, at least one outlet, a port communicating with a pre-charged diaphragm tank, and a port communicating with a pressure switch. The actuator body includes a movable member which, in a first position, seals the inlet port and provides fluidic communication with the pressure switch port. In a second position, the movable member opens the inlet port and seals the pressure switch port. A spring is disposed within the actuator body to urge the movable member toward the first position.

In one embodiment, a relief valve is provided to prevent large over-pressures.

In yet another embodiment, a valve is provided to prevent the trapping of high pressure fluid which would prevent the turning on of the motor in a connection to a municipal water system.

DESCRIPTION OF THE PREFERRED EMBODIMENT

Figure 1:
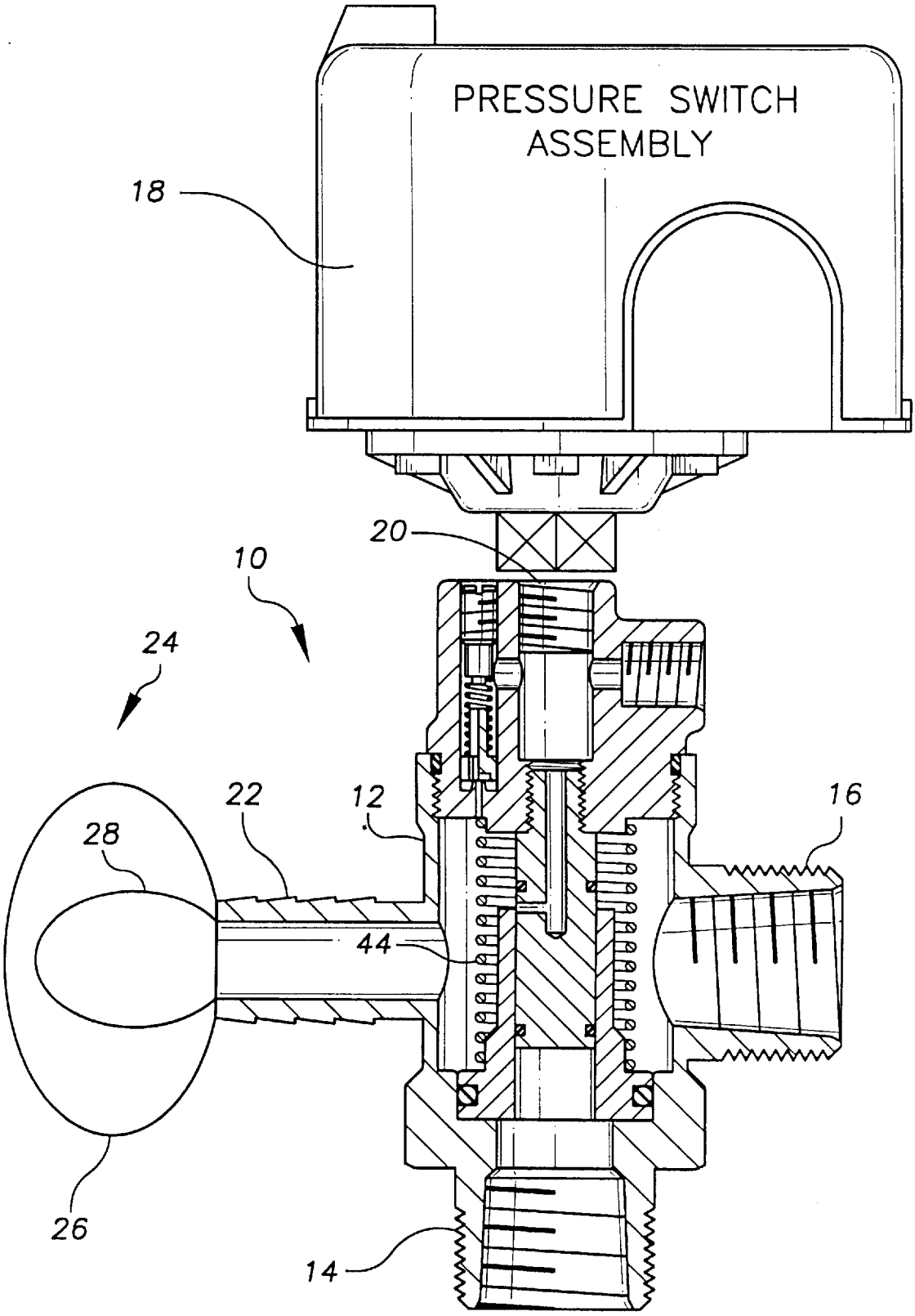
FIG. 1 is a cross-sectional view, partly exploded, of the actuator valve of the invention along with a pressure switch.

With reference first to FIG. 1, an actuator system 10 includes an actuator body portion 12. The body portion 12 includes an inlet connection portion 14 which is adapted to be connected to a pump (not shown). As will be appreciated by those skilled in the art, the pump is connected to a source of water such as a well or a municipal water supply. The actuator body 12 also includes an outlet port 16 from which water is discharged as, for example, through a faucet (not shown). There may be additional outlet ports. A pressure switch assembly 18 includes an electrical switch which, when closed, turns on a pump and which, when opened, turns off a pump. The pressure switch assembly 18 is connected to a port 20 which communicates with the pressure switch 18. A port 22 is connected to a pre-charged diaphragm tank assembly 24. The tank assembly 24 includes an outer enclosure 26 and an inner diaphragm 28. Water fills the diaphragm 28 which expands against air entrapped between the diaphragm 28 and the enclosure 26 to pressurize the water.

The actuator assembly 10 will now be described in more detail in conjunction with FIG. 2. Disposed within the actuator body 12 is a movable member 30 which is guided in its sliding motion by a fixed support 33. As shown in the figure, the movable member 30 seats within a recess portion 32 and is in sealing relation by virtue of a square o-ring seal 34. The support member 33 includes spaced apart square o-ring seals 36 and 38. The fixed support 33 includes a transverse passageway 40 which is in fluid communication with an axial passageway 42. The axial passageway 42 communicates with the port 20 leading to the pressure switch 18 (FIG. 1).

The operation of the actuator 10 of the invention will now be described in conjunction with FIG. 2 and FIGS. 3A–D. When the movable member 30 is fully seated within the recess 32, the inlet port 14 is sealed while the port 40 is in fluidic communication with fluid within the actuator body 12 since the passageway 40 is below the o-ring seal 38 and is thus unsealed. Thus, the pressure switch 18 responds to pressure within the actuator body 12 through the passageways 40 and 42. The diaphragm 28 is distended by being filled with water and is compressed by air between the diaphragm 28 and the enclosure 26. When a faucet is opened, water will be discharged from the pre-charged diaphragm tank 24 through the outlet port 16. As water flows through the outlet port 16, pressure will decrease as the diaphragm 28 decreases in volume. The pressure decrease will be communicated through the unsealed passageway 40 to the pressure switch 18. The pressure switch 18, as will be appreciated by those skilled in the art, is adjusted to have a cut-in pressure setting below which the switch activates a pump motor and a cut-out pressure setting which deactivates the pump motor. Thus, when the pressure falls the pump motor will be activated causing fluid to flow through the inlet port 14. Pressure generated by the pump will cause the movable member 30 to move out of the recess 32 by overcoming the force of a spring 44 which urges the movable member downwardly. Under the influence of the pump, the movable member 30 moves upwardly as shown in FIGS. 3A and 3B. The spring 44 is not shown in FIGS. 2 and 3A–D for clarity. Hydrodynamic forces arising from the flow of water through the inlet port 14 keeps the movable member in the upward position against the force of the spring 44. Thus, water continues to flow through the output port 16. It is important to note that when the movable member 30 is in its upward position as shown in FIG. 3B, the transverse passageway 40 is beneath the o-ring seal 38 so that the passageway 40 is now sealed off from, and cannot respond to, fluid pressure changes in the actuator body 12. Therefore, the pump will remain running as long as fluid is flowing through the outlet 16. When, however, a faucet is turned off, flow through the outlet port 16 will stop. For a while, flow will continue through the port 22 into the diaphragm 28. Once the pressures equilibrate, flow will stop entirely so that there will be no further hydrodynamic force holding the movable member 30 open against the spring 44. The movable member 30 then will move downwardly as shown in FIG. 3C and finally all the way downwardly into the recess 32 as shown in FIG. 3D. When the member 30 is in the downward position shown in FIG. 3D, the passageway 40 is now beneath the o-ring seal 38 so that the passageway 40 is unsealed and "feels" the pressure in the body 12. This high pressure is communicated to the pressure switch 18 which shuts off the pump motor. When a faucet is once again opened, the process just described is repeated with an activation of the pump motor for as long is fluid is flowing through the outlet 16 and a deactivation of the motor once fluid flow ceases.

Figure 2:
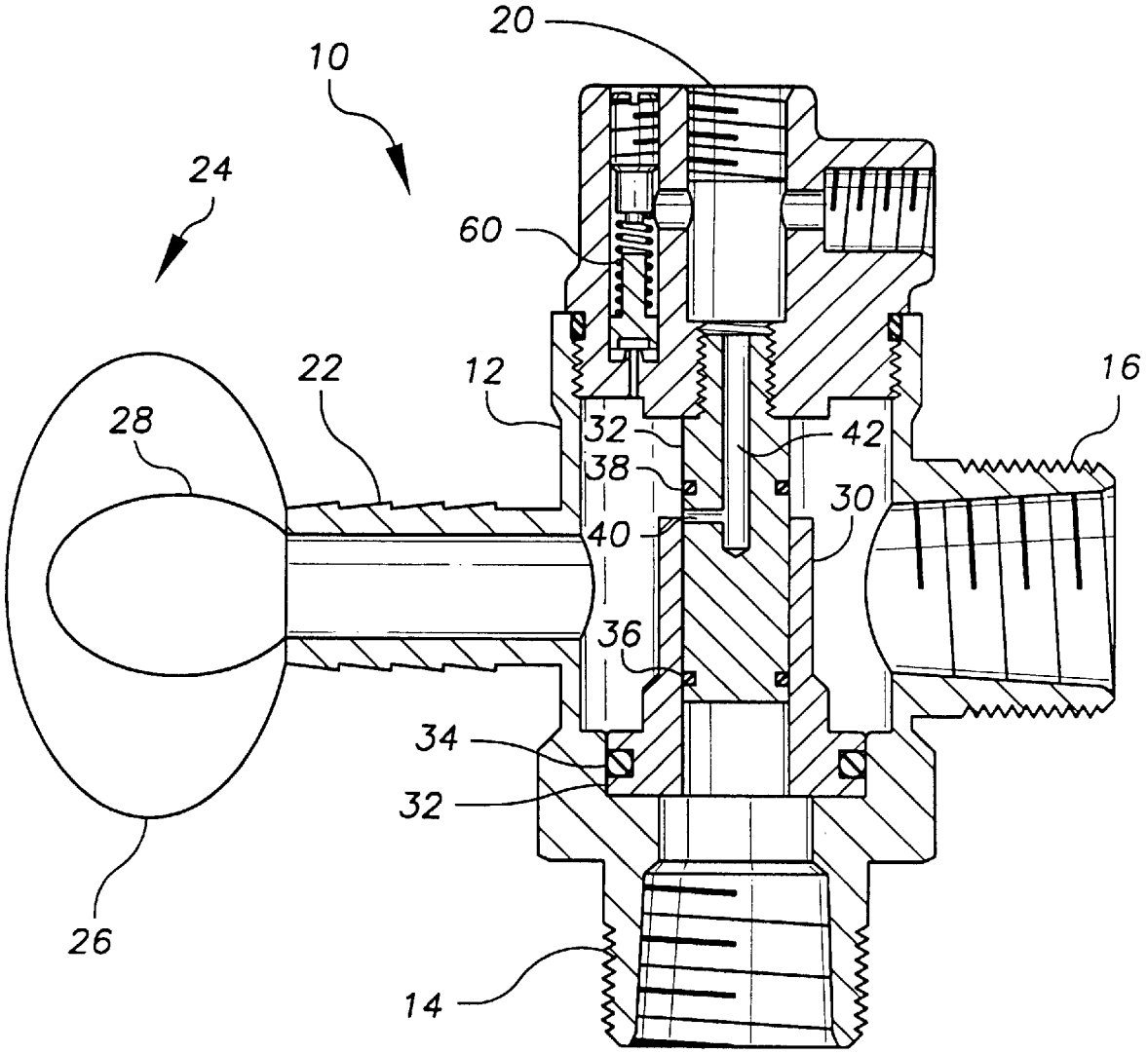
FIG. 2 is a cross-sectional view of the actuator valve of the invention.
Figure 3B:
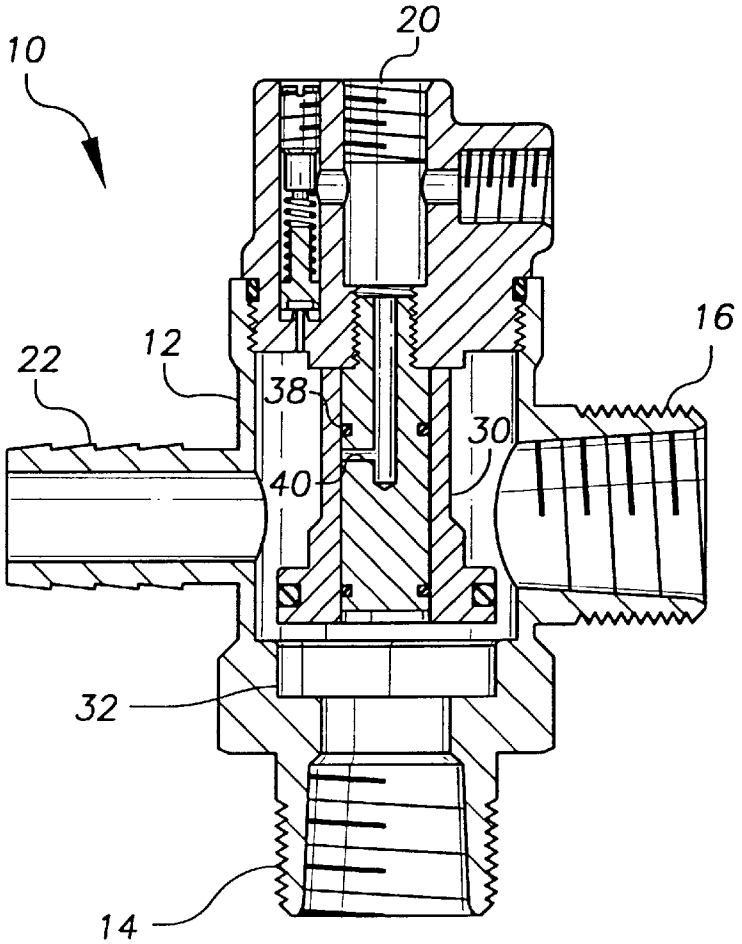
FIGS. 3A, 3B, 3C and 3D are cross-sectional views of the actuator valve in different states of operation.
Figure 3A:
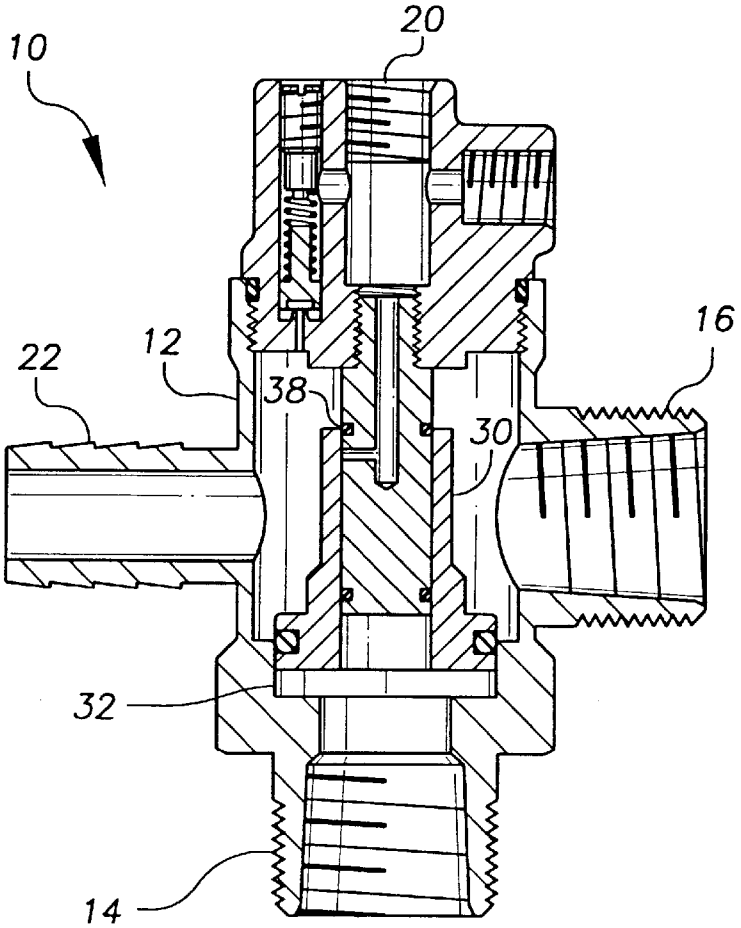
Figure 3D:
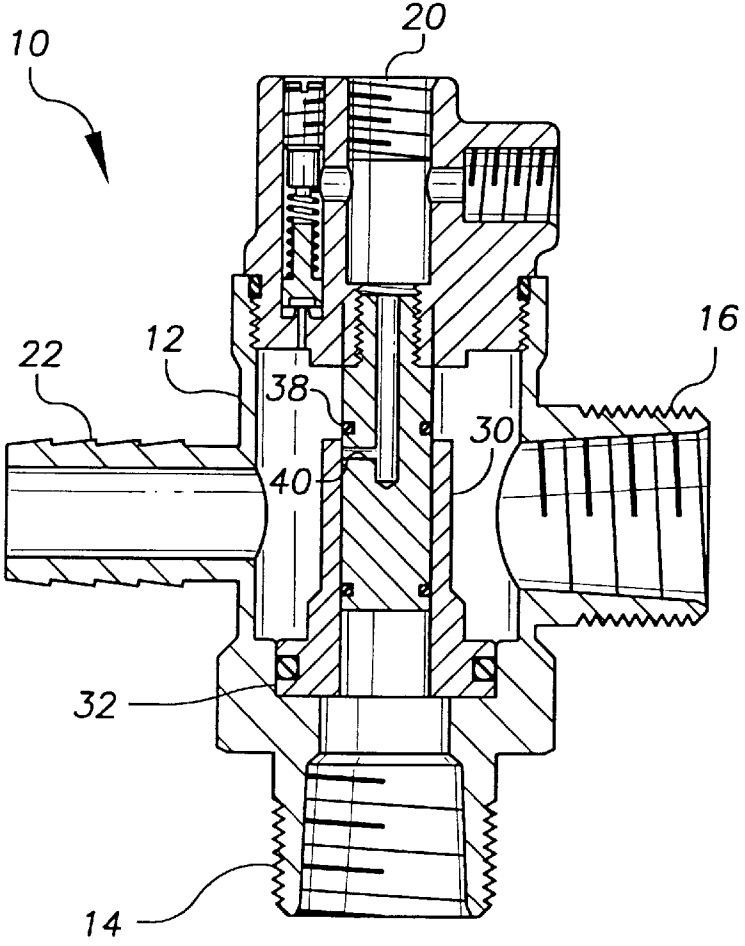
Figure 3C:
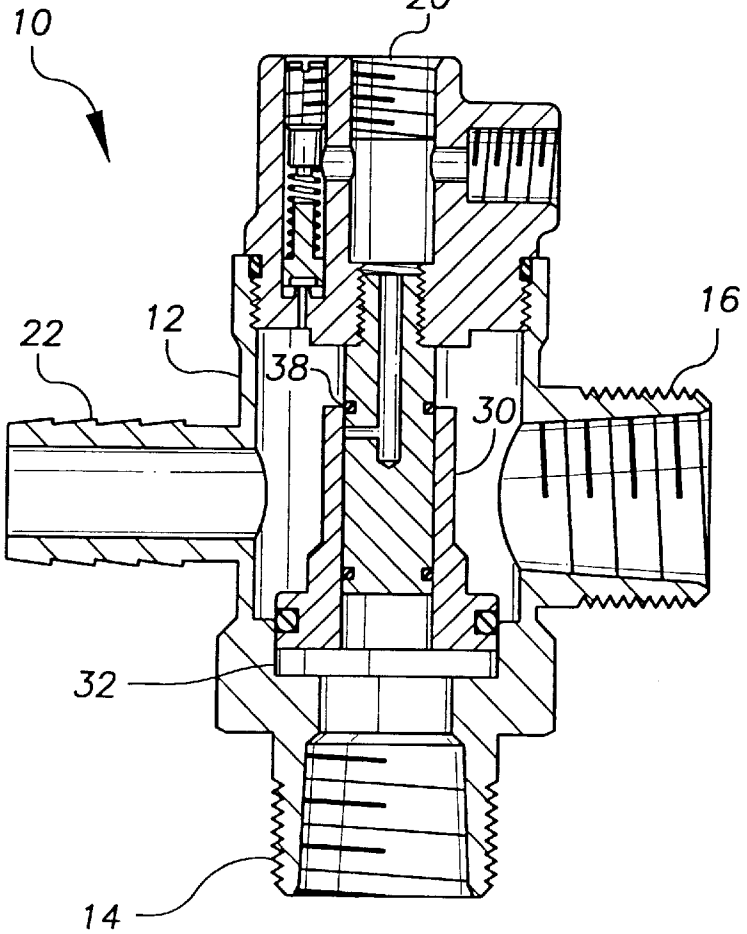
Figure 4:
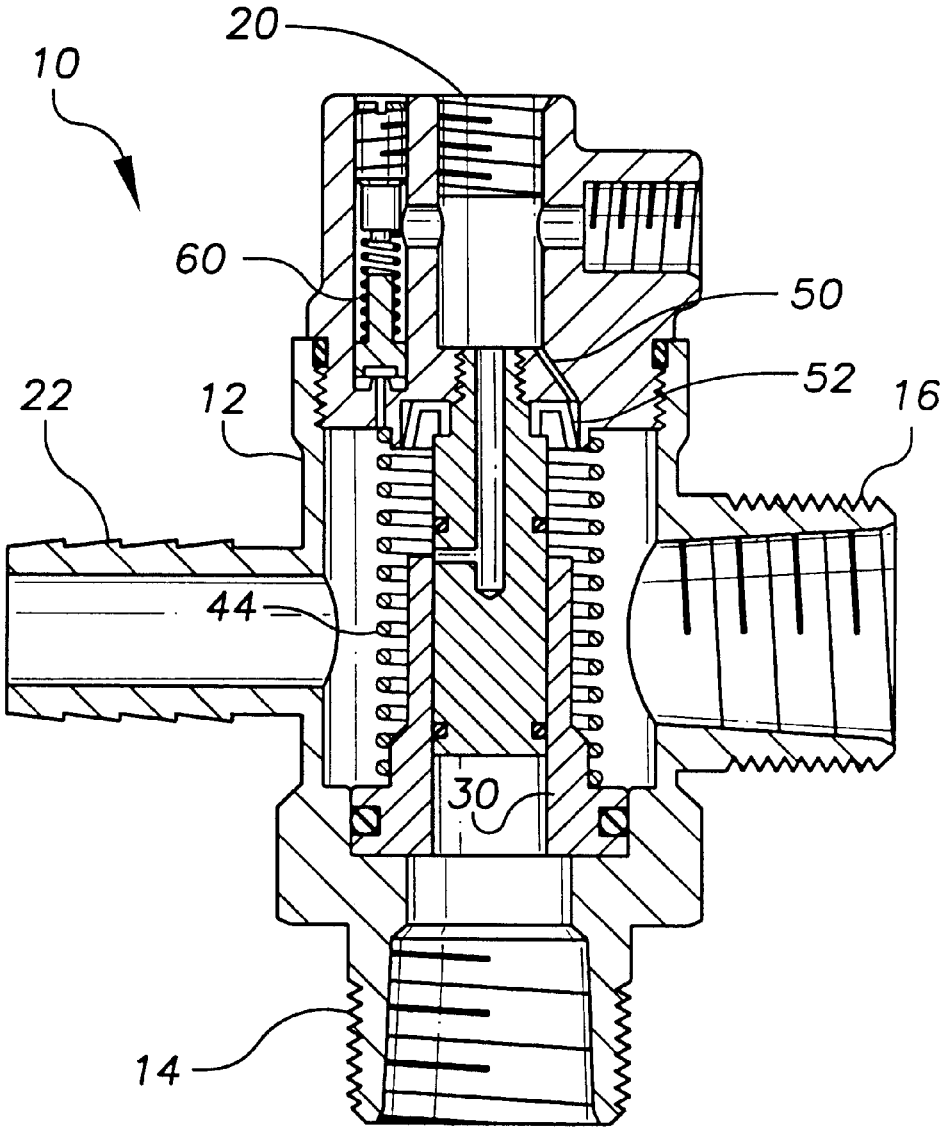
FIG. 4 is a cross-sectional view of another embodiment of the invention including means for eliminating trapped pressures.

With reference now to FIG. 4, the actuator 10 has been modified from the embodiment of FIG. 2 adapting it particularly for connection to a municipal water supply source. In such a situation, a pump and the actuator of the invention are used to boost an already pressurized municipal water system. In such an application, pressure in the port 20 leading to the pressure switch can become trapped at a level higher than the cut-in level for the pump so that the pump will not turn on. To circumvent this situation, a passageway 50 is provided to permit communication between the passageway 20 and the interior of the actuator body 12. A U-cup seal 52 is provided to selectively seal the passageway 50. In this arrangement, if the pressure leading to the pressure switch 18 is higher than that in the rest of the actuator, the flexible U-cap seal will deflect to open the passageway 50 thereby allowing the pressure to equalize. On the other hand, when pressure within the actuator body 12 is higher than that within the passage 20 leading to the pressure switch 18 the U-cup will expand as shown in the figure to block the passageway 50.

Also shown in FIG. 4 as well as in the embodiment of FIG. 2 is a relief valve assembly 60. The relief valve 60 is a poppet-type valve which may be set to open at a pre-selected, high pressure. When the valve 60 opens, the high pressure fluid communicates with the pressure switch 18 assuring that it cuts off.

Those skilled in the art will appreciate that the embodiments disclosed herein may be made of any suitable materials such as metals or plastics or a combination thereof. The embodiments disclosed herein have several advantages over prior art designs based on hydrostatic/hydrodynamic principles. In U.S. Pat. No. 5,509,787 discussed above, the area on one side of the movable member had to be smaller than that on the other side so that hydrostatic forces would re-seat the movable member. In the present invention the areas may be equal since a spring is used to re-seat the movable member 30. Importantly, only the single spring 44 is required to provide pressure switch control unlike the dual spring design in U.S. Pat. No. 3,871,792. In the present invention, the spring 44 need only overcome the sliding friction of the movable member 30 over the fixed support 33 and no other spring is required.

It is intended that all modifications and variations of the present invention be included with the scope of the appended claims.

What is claimed is:

1. Hydraulic actuator comprising:

an actuator body including an inlet, at least one outlet, a port communicating with a pre-charged diaphragm tank, and a port communicating with a pressure switch;

wherein the port communicating with the pre-charged diaphragm tank is neither one of the inlet and one of the outlet; and the port communicating with the pressure switch is neither one of the inlet, one of the outlet, and one of the port communicating with the pre-charged diaphragm tank;

the actuator body including a movable member which, in a first position, seals the inlet port and provides fluidic communication with the pressure switch; and in a second position, opens the inlet port and seals the pressure switch port; and a spring disposed within the actuator body urging the movable member toward the first position.

2. The hydraulic actuator of claim 1, further including a support member which guides the movable member in a sliding motion.

3. The hydraulic actuator of claim 2, wherein the support member includes a transverse passageway which is in fluid communication with an axial passageway.

4. The hydraulic actuator of claim 3, wherein the axial passageway communicates with the port communicating with the pressure switch.

5. The hydraulic actuator of claim 4, further including a relief valve which, in an open position, allows high pressure fluid to communicate with the pressure switch.

6. The hydraulic actuator of claim 5, wherein the relief valve is a poppet-type valve.

7. The hydraulic actuator of claim 6, wherein the relief valve is set to open at a pre-selected, high pressure.

8. The hydraulic actuator of claim 1, further including a relief valve which, in an open position, allows high pressure fluid to communicate with the pressure switch.

9. The hydraulic actuator of claim 8, wherein the relief valve is set to open at a pre-selected, high pressure.

10. Hydraulic actuator comprising:

an actuator body including an inlet, at least one outlet, a port communicating with a pre-charged diaphragm tank, a port communicating with a pressure switch, and a passageway communicating with the port communicating with the pressure switch and with an interior of the actuator body;

wherein the port communicating with the pre-charged diaphragm tank is neither one of the inlet and one of the outlet; and the port communicating with the pressure switch is neither one of the inlet, one of the outlet, and one of the port communicating with the pre-charged diaphragm tank;

the actuator body including a movable member which, in a first position, seals the inlet port and provides fluidic communication with the pressure switch; and in a second position, opens the inlet port and seals the pressure switch port; and a spring disposed within the actuator body urging the movable member toward the first position.

11. The hydraulic actuator of claim 10, further including a U-cup seal to relieve trapped pressure in the port communicating with the pressure switch.

12. The hydraulic actuator of claim 11, wherein the U-cup seal is positioned to selectively seal the passageway.

13. The hydraulic actuator of claim 10 further including a support member which guides the movable member in a sliding motion.

14. The hydraulic actuator of claim 13, wherein the support member includes a transverse passageway which is in fluid communication with an axial passageway.

15. The hydraulic actuator of claim 14, wherein the axial passageway communicates with the port communicating with the pressure switch.

16. The hydraulic actuator of claim 15, wherein the support member includes a plurality of spaced apart seals.

17. The hydraulic actuator of claim 15, further including a relief valve which, in an open position, allows high pressure fluid to communicate with the pressure switch.

18. The hydraulic actuator of claim 17, wherein the relief valve is a poppet-type valve.

19. The hydraulic actuator of claim 18, wherein the relief valve is set to open at a pre-selected, high pressure.

20. The hydraulic actuator of claim 10, further including a relief valve which, in an open position, allows high pressure fluid to communicate with the pressure switch.

* * * * *